US005806113A

United States Patent [19]

McMahan et al.

[11] Patent Number: 5,806,113

[45] Date of Patent: Sep. 15, 1998

[54] MOTION CONTROLLED CRADLE

[76] Inventors: Michael McMahan; Nancy McMahan, both of 2804 Knox Ave., Los Angeles, Calif. 90039

[21] Appl. No.: 854,254

[22] Filed: May 9, 1997

[51] Int. Cl.[6] ..... A47D 9/02

[52] U.S. Cl. ..... 5/109; 5/105; 5/108; 5/93.1

[58] Field of Search ..... 5/109, 105, 108, 5/93.1, 101, 104, 107; 601/49, 86, 90, 98, 115, 146

[56] References Cited

U.S. PATENT DOCUMENTS

| | | | |
|---|---|---|---|
| 1,704,914 | 3/1929 | Fairweather | 5/109 |
| 3,031,698 | 5/1962 | Muzzey | 5/109 |
| 3,261,033 | 7/1966 | Martin | 5/109 |
| 3,653,080 | 4/1972 | Hafele | 5/108 |
| 3,818,517 | 6/1974 | Casella | 5/109 |
| 4,793,010 | 12/1988 | Gross et al. | 5/109 |
| 4,947,152 | 8/1990 | Hodges | 340/573 |

*Primary Examiner*—Kenneth J. Dorner
*Assistant Examiner*—Fredrick Conley

[57] ABSTRACT

A motion controlled cradle including a rocking assembly adapted to rock the cradle upon the receipt of an activation signal. Further provided is an motion sensor adapted to transmit a motion signal upon the detection of motion of the small child within the cradle. Next provided is a mechanism for transmitting an activation signal to the rocking assembly upon the receipt of the motion signal. Finally, a tape player is connected to the means. The tape player is adapted to play a tape upon the receipt of the activation signal.

1 Claim, 2 Drawing Sheets

MOTION CONTROLLED CRADLE

BACKGROUND OF THE INVENTION

1. Field of the Invention

The present invention relates to a motion controlled cradle and more particularly pertains to automatically rocking a cradle and further playing music for a predetermined amount of time upon the detection of motion.

2. Description of the Prior Art

The use of automatic rocking cradles is known in the prior art. More specifically, automatic rocking cradles heretofore devised and utilized for the purpose of rocking a cradle without manual intervention are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 4,752,980 to Nafte; U.S. Pat. No. 3,952,343 to Wong; U.S. Pat. No. 4,881,285 to Zeeb; U.S. Pat. No. 4,474,185 to Diamond; U.S. Pat. No. 4,895,160 to Reents; and U.S. Pat. No. 5,303,433 to Jang.

In this respect, the motion controlled cradle according to the present invention substantially departs from the conventional concepts and designs of the prior art, and in so doing provides an apparatus primarily developed for the purpose automatically rocking a cradle and further playing music for a predetermined amount of time upon the detection of motion.

Therefore, it can be appreciated that there exists a continuing need for a new and improved motion controlled cradle which can be used for automatically rocking a cradle and further playing music for a predetermined amount of time upon the detection of motion. In this regard, the present invention substantially fulfills this need.

SUMMARY OF THE INVENTION

In view of the foregoing disadvantages inherent in the known types of automatic rocking cradles now present in the prior art, the present invention provides an improved motion controlled cradle. As such, the general purpose of the present invention, which will be described subsequently in greater detail, is to provide a new and improved motion controlled cradle which has all the advantages of the prior art and none of the disadvantages.

To attain this, the present invention essentially comprises a crib with a top rectangular portion having a bottom face, a pair of side faces, and a pair of end faces defining an upper lip and an interior space. See FIG. 3. Such interior space is adapted for laying a small child therein. The cradle further includes a pair of semi-circular rockers coupled to the bottom face of the top rectangular portion adjacent the end faces thereof. This structure permits rocking of the cradle. As shown in FIGS. 2 & 3, a housing is included with a top extent and a bottom extent. The top extent has a rectangular configuration with a top face, a bottom face, an outboard end face, an inboard end face, and a pair of side faces defining an interior space. The bottom extent has a pair of downwardly extending tabs integrally coupled to the bottom face of the top extent of the housing. These tabs extend downwardly from the bottom face and define a lateral slot. As shown in FIG. 3, the downwardly extending tabs include an outboard tab in coplanar relationship with the outboard end face of the top extent of the housing and an inboard tab situated at a central extent of the bottom face of the top extent. By this structure, the slot of the housing may be releasably engaged with the upper lip of one of the end faces of the cradle. For securing the housing to the upper lip of the crib, a securement mechanism is provided. The securement mechanism includes a threaded rod threadedly engaged within a threaded bore formed in the outboard tab. Rotatably coupled to a first end of the threaded rod is an engagement plate. The engagement plate is situated within the slot. Associated therewith is an adjustment knob fixedly and coaxially coupled to a second end of the threaded rod. To this end, the adjustment knob may be rotated to selectively abut the engagement plate with the cradle. Next provided is a rocking assembly including a motor situated within the interior space of the housing. The rocking assembly further includes a drive wheel attached to a rotor of the motor. An elongated linear drive shaft is included with a top end rotatably coupled in an eccentric relationship with the drive wheel. A second end of the drive shaft has a rubber shoe positioned thereon for engaging a floor adjacent the cradle at a position offset in relation to a central extent of the cradle. As can be seen in FIG. 3, the rod extends through a hollow interior of the outboard tab of the housing. In use, the motor is adapted to rock the cradle only upon the receipt of an activation signal. Further provided is a tape player exteriorly positioned on an inboard face of the housing. The tape player includes both a playback mechanism and a speaker. In operation, the tape player is designed to play a tape only upon the receipt of the activation signal. An infrared motion sensor is situated on the bottom face of the housing between the inboard face of the housing and the inboard tab thereof. Upon the detection of motion of the small child within the cradle, the motion sensor is adapted to transmit a motion signal. With reference now to FIG. 1, it can be seen that timer means is connected to the motion sensor, motor, and the tape player. Such timer means is adapted for transmitting the activation signal thereto for a predetermined amount of time upon the receipt of the motion signal. Also included is delay means. The delay means is connected to the timer means and the motion sensor for preventing the transmission of the activation signal from the timer means upon the receipt of the motion signal within a predetermined amount of time from a cessation of the activation signal.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved motion controlled cradle which has all the advantages of the prior art automatic rocking cradles and none of the disadvantages.

It is another object of the present invention to provide a new and improved motion controlled cradle which may be easily and efficiently manufactured and marketed.

It is a further object of the present invention to provide a new and improved motion controlled cradle which is of a durable and reliable construction.

An even further object of the present invention is to provide a new and improved motion controlled cradle which is susceptible of a low cost of manufacture with regard to both materials and labor, and which accordingly is then susceptible of low prices of sale to the consuming public, thereby making such motion controlled cradle economically available to the buying public.

Still yet another object of the present invention is to provide a new and improved motion controlled cradle which provides in the apparatuses and methods of the prior art some of the advantages thereof, while simultaneously overcoming some of the disadvantages normally associated therewith.

Still another object of the present invention is to automatically rock a cradle and further play music for a predetermined amount of time upon the detection of motion.

Lastly, it is an object of the present invention to provide a new and improved motion controlled cradle including a rocking assembly adapted to rock the cradle upon the receipt of an activation signal. Further provided is an motion sensor adapted to transmit a motion signal upon the detection of motion of the small child within the cradle. Next provided is a mechanism for transmitting an activation signal to the rocking assembly upon the receipt of the motion signal. Finally, a tape player is connected to the means. The tape player is adapted to play a tape upon the receipt of the activation signal.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
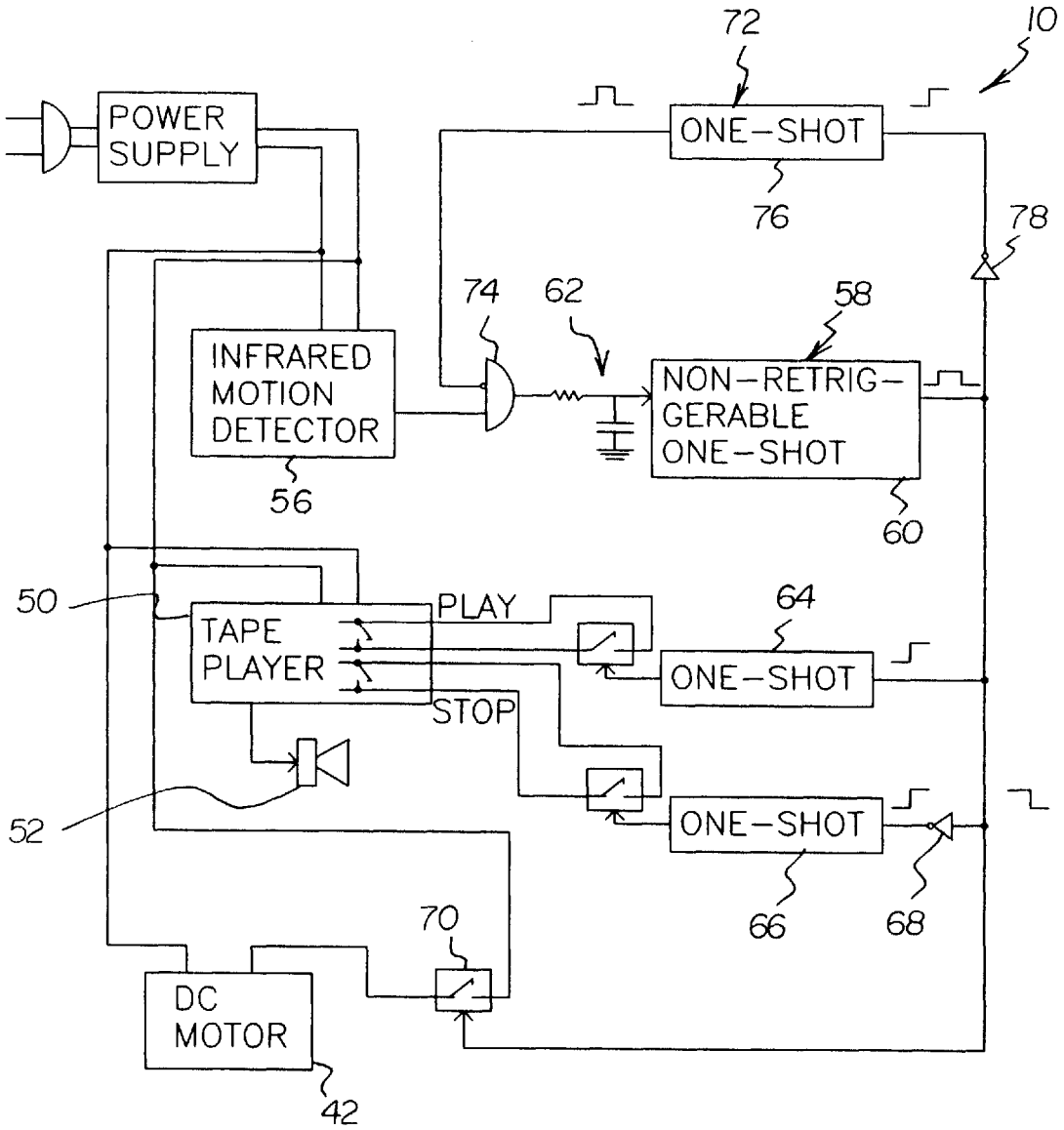
FIG. 1 is a schematic diagram showing the interconnection between the various electrical components of the present invention.

With reference now to the drawings, and in particular to FIG. 1 thereof, a new and improved motion controlled cradle embodying the principles and concepts of the present invention and generally designated by the reference numeral 10 will be described.

The present invention, the new and improved motion controlled cradle, is comprised of a plurality of components. Such components in their broadest context include a housing, rocking assembly, tape player, motion sensor, timer means and delay means. Such components are individually configured and correlated with respect to each other so as to attain the desired objective.

More specifically, it will be noted that the system 10 of the present invention includes a cradle 12 with a top rectangular portion 14 having a bottom face, a pair of side faces, and a pair of end faces defining an upper lip and an interior space. See FIG. 3. Such interior space is adapted for laying a small child therein. The crib further includes a pair of semi-circular rockers 16 coupled to the bottom face of the top rectangular portion adjacent the end faces thereof. This structure permits rocking of the cradle.

Figure 2:
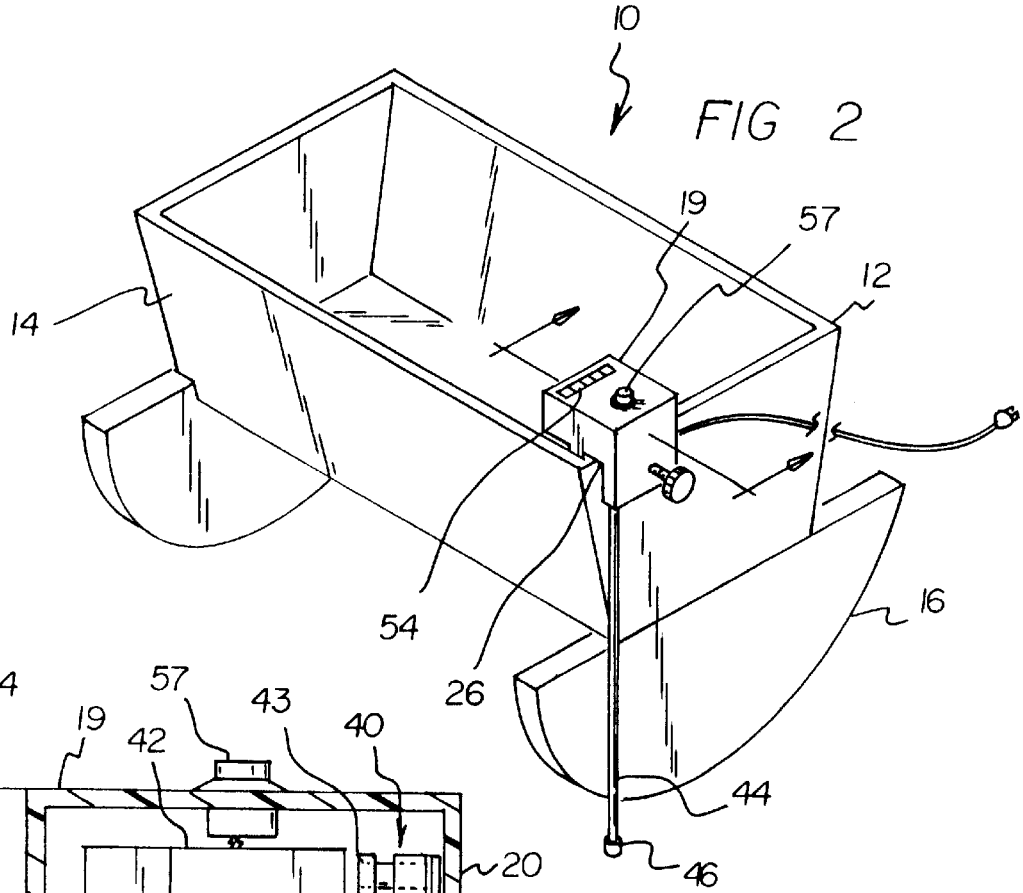
FIG. 2 is a perspective illustration of the present invention is use.
Figure 3:
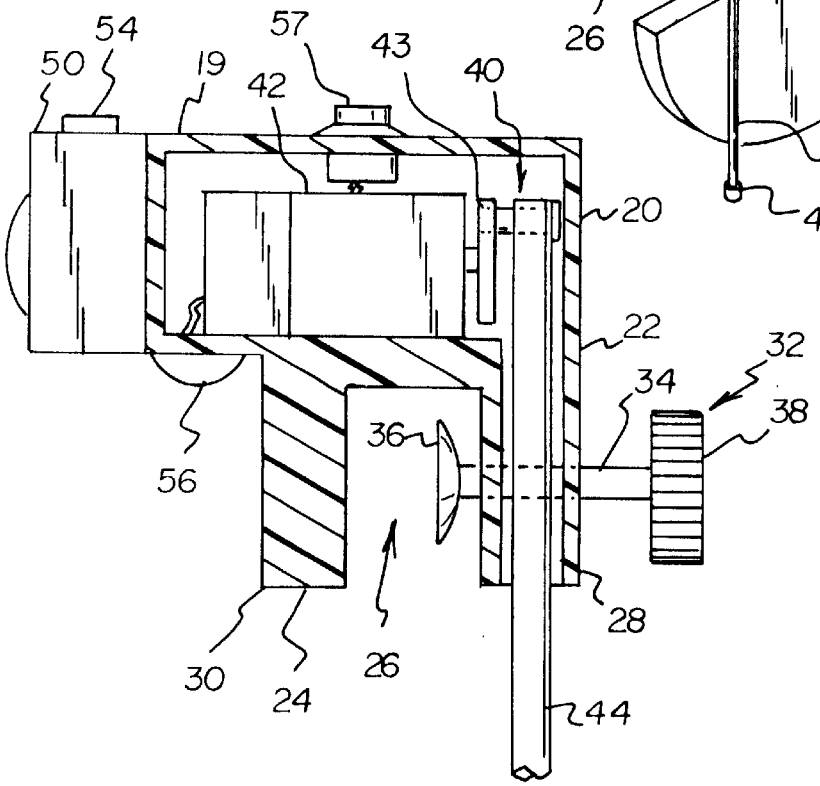
FIG. 3 is a cross-sectional view of the housing of the present invention taken along the cross-sectional line of FIG. 2.

As shown in FIGS. 2 & 3, a housing 19 is included with a top extent 20 and a bottom extent 22. The top extent has a rectangular configuration with a top face, a bottom face, an outboard end face, an inboard end face, and a pair of side faces defining an interior space. The bottom extent has a pair of downwardly extending tabs 24 integrally coupled to the bottom face of the top extent of the housing. These tabs extend downwardly from the bottom face and define a lateral slot 26. As shown in FIG. 3, the downwardly extending tabs include an outboard tab 28 in coplanar relationship with the outboard end face of the top extent of the housing and an inboard tab 30 situated at a central extent of the bottom face of the top extent. By this structure, the slot of the housing may be releasably engaged with the upper lip of one of the end faces of the crib. Such engagement is preferably afforded adjacent one of the side faces of the cradle.

For securing the housing to the upper lip of the cradle, a securement mechanism 32 is provided. The securement mechanism includes a threaded rod 34 threadedly engaged within a threaded bore formed in the outboard tab. Rotatably coupled to a first end of the threaded rod is an engagement plate 36. The engagement plate is situated within the slot and has a flat circular engagement surface. Associated therewith is an adjustment knob fixedly 38 and coaxially coupled to a second end of the threaded rod. To this end, the adjustment knob may be rotated to selectively abut the engagement plate with the cradle.

Next provided is a rocking assembly 40 including a motor 42 situated within the interior space of the housing. It is imperative that the motor be adapted to utilize DC power to prevent the presence of harmful electromagnetic radiation. The rocking assembly further includes a drive wheel 43 attached to a rotor of the motor. An elongated linear drive shaft 44 is provided with a top end rotatably coupled in an eccentric relationship with the drive wheel. A second end of the drive shaft has a rubber shoe 46 positioned thereon for engaging a floor adjacent the cradle at a position offset in relation to a central extent of the cradle. As can be seen in FIG. 3, the rod extends through a hollow interior of the outboard tab of the housing. In use, the motor is adapted to rock the cradle only upon the receipt of an activation signal. This is accomplished by the shaft elevating a first side face of the cradle with respect to the other in a cyclical manner.

Further provided is a tape player 50 exteriorly positioned on an inboard face of the housing. The tape player includes both a playback mechanism and a speaker 52. In operation, the tape player is designed to play a tape only upon the receipt of the activation signal. Ideally, a lullaby or soothing sounds are played by the tape player during use. As shown in FIG. 2, the tape player comprises a plurality of conventional control buttons 54 including a stop button, a rewind button, a fast forward button, a play button, a continuous play button, a reverse button, and a record button. Such buttons allow conventional use of the tape play as is readily known in the art of tape players. Alternatively, other forms of playback may be utilized such as a CD-ROM or the like.

An infrared motion sensor 56 is situated on the bottom face of the housing between the inboard face of the housing and the inboard tab thereof. Upon the detection of motion of the small child within the cradle, the motion sensor is adapted to transmit a motion signal. The unique positioning of the infrared sensor precludes inadvertent detection of motion exterior of the cradle. As shown in FIGS. 2 & 3, a button 57 is situated on a top face of the housing for manually transmitting the motion signal upon the depression thereof.

With reference now to FIG. 1, it can be seen that timer means 58 is connected to the motion sensor, button, motor, and the tape player. Such timer means is adapted for transmitting the activation signal to the motor and tape player for a predetermined amount of time upon the receipt of the motion signal. Preferably, the timer means maintains the activation signal active high for 15 minutes. The timer means preferably comprises a non-retriggerable one-shot multi-vibrator 60. At the input of the timer means is an RC network 62 that is adapted to filter out quick spikes.

It should be noted that the tape player is activated by the activation signal by means of a second one-shot multivibrator 64 that is connected between the play button and the timer means. Such multivibrator is adapted to activate the play button of the tape player upon the receipt of the activation signal. To effect stopping of the tape, a third one-shot multivibrator 66 is connected between the stop button and the timer means. This multivibrator is preceded by an inverter 68 that produces a rising pulse upon the cessation of the activation signal which, in turn, activates the stop button, thereby stopping the play of the tape. As shown in FIG. 1, voltage controlled switches 70 are connected between the tape player and the motor and the respective multivibrators for ensuring that such components receive appropriate amount of power to operate.

Also included is delay means 72. The delay means is connected to the timer means and the motion sensor for preventing the transmission of the activation signal from the timer means upon the receipt of the motion signal within a predetermined amount of time from a cessation of the activation signal. To accomplish this, the timer means is preceded by an AND gate 74 with an input connected to the motion sensor and an output connected to the timer means. Further, the delay means includes a fourth multi-vibrator 76 connected between an output of the timer means and another input of the AND gate. Such input is an inverting input. Also, the fourth multi-vibrator is preceded by an inverter 78. By this structure upon the cessation of the activation signal, a disabling signal is sent to the AND gate for ideally about 15 seconds thereby preventing the transmission of the motion signal to the timer means during that time. This allows time for the rocking of the cradle to subside prior to the timer means being capable of reactivating the rocking assembly.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A motion controlled cradle comprising, in combination:

a cradle with a top rectangular portion having a bottom face, a pair of side faces, and a pair of end faces defining an upper lip and an interior space for laying a small child in, the cradle further including a pair of semi-circular rockers coupled to the bottom face of the top rectangular portion adjacent the end faces thereof;

a housing with a top extent and a bottom extent, the top extent having a rectangular configuration with a top face, a bottom face, an outboard end face, an inboard end face, and a pair of side faces defining an interior space, the bottom extent having a pair of downwardly extending tabs integrally coupled to the bottom face of the top extent of the housing and extended downwardly therefrom thereby defining a lateral slot, the downwardly extending tabs including an outboard tab in coplanar relationship with the outboard end face of the top extent of the housing and an inboard tab situated at a central extent of the bottom face of the top extent, whereby the slot of the housing may be releasably engaged with the upper lip of one of the end faces of the cradle;

a securement mechanism for securing the housing to the upper lip of the cradle, the securement mechanism including a threaded rod threadedly engaged within a threaded bore formed in the outboard tab, an engagement plate with a circular engagement surface rotatably coupled to a first end of the threaded rod and situated within the slot, and an adjustment knob fixedly and coaxially coupled to a second end of the threaded rod, whereby the adjustment knob may be rotated to selectively abut the engagement plate with the cradle;

a rocking assembly including a DC motor situated within the interior space of the housing, a drive wheel attached to a rotor of the motor, an elongated linear drive shaft with a top end rotatably coupled in an eccentric relationship with the drive wheel and a second end having a rubber shoe for engaging a floor adjacent the crib at a position offset in relation to a central extent of the crib, wherein the rod extends through a hollow interior of the outboard tab of the housing, the motor adapted to rock the cradle only upon the receipt of an activation signal;

a tape player exteriorly positioned on an inboard face of the housing, the tape player including a playback mechanism and a speaker, the tape player adapted to play a tape only upon the receipt of the activation signal, wherein the tape player includes a stop button, a rewind button, a fast forward button, a play button, a continuous play button, a reverse button and a record button;

an infrared motion sensor situated on the bottom face of the housing between the inboard face of the housing and the inboard tab thereof, the motion sensor adapted to transmit a motion signal upon the detection of motion of the small child within the cradle, the infrared motion sensor further including a button for transmitting the motion signal upon the depression thereof;

timer means connected to the motion sensor, button, motor, and the tape player for transmitting the activation signal to the motor and tape player for a predetermined amount of time upon the receipt of the motion signal; and delay means connected to the timer means and the motion sensor for preventing the transmission of the activation signal from the timer means upon the receipt of the motion signal within a predetermined amount of time from a cessation of the activation signal.

* * * * *